US008870681B2

(12) United States Patent
Yamamoto

(10) Patent No.: US 8,870,681 B2
(45) Date of Patent: Oct. 28, 2014

(54) GOLF CLUB HEAD AND GOLF CLUB

(71) Applicant: Dunlop Sports Co. Ltd., Kobe (JP)

(72) Inventor: Akio Yamamoto, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 0 days.

(21) Appl. No.: 13/669,995

(22) Filed: Nov. 6, 2012

(65) Prior Publication Data

US 2013/0116065 A1 May 9, 2013

(30) Foreign Application Priority Data

Nov. 7, 2011 (JP) ..... 2011-243736

(51) Int. Cl.
*A63B 53/04* (2006.01)

(52) U.S. Cl.
CPC ..... *A63B 53/04* (2013.01); *A63B 2053/0408* (2013.01); *A63B 2053/0491* (2013.01); *A63B 53/0466* (2013.01); *A63B 2053/0458* (2013.01); *A63B 2053/0412* (2013.01); *A63B 2053/0433* (2013.01)
USPC ..... 473/345

(58) Field of Classification Search
USPC ..... 473/345
See application file for complete search history.

(56) References Cited

U.S. PATENT DOCUMENTS

| | | | | |
|---|---|---|---|---|
| 7,497,789 | B2 * | 3/2009 | Burnett et al. | 473/342 |
| 2002/0193175 | A1 | 12/2002 | Soracco et al. | |
| 2003/0134693 | A1 | 7/2003 | Nakahara et al. | |
| 2006/0052177 | A1 * | 3/2006 | Nakahara et al. | 473/329 |

FOREIGN PATENT DOCUMENTS

| | | | |
|---|---|---|---|
| JP | 2003-205055 | A | 7/2003 |
| JP | 2003-245381 | A | 9/2003 |
| JP | 2004-283543 | A | 10/2004 |

* cited by examiner

*Primary Examiner* — Michael Dennis
(74) *Attorney, Agent, or Firm* — Birch, Stewart, Kolasch & Birch, LLP

(57) ABSTRACT

A golf club head with a hollow portion therein, includes a head main body provided with at least one opening which includes at least a part of a sole portion forming a bottom of the head, a resin member composed of a fiber reinforced resin which is attached to the head main body so as to close the opening, and a reinforcing member across the opening having a specific gravity greater than that of the resin member.

11 Claims, 8 Drawing Sheets

GOLF CLUB HEAD AND GOLF CLUB

BACKGROUND OF THE INVENTION

1. Field of the Invention

The present invention relates to a golf club head and a golf club in which the hitting feel is improved while maintaining a low center of gravity.

2. Description of the Related Art

In recent years, a golf club head (a) as shown in FIG. 8 is proposed. The club head (a) comprises: a head main body (d) being provided with an opening in the crown portion (b); and a resin member (c) attached to the head main body (d) to close the opening. Since the resin member (c) is composed of a fiber reinforced resin with a low specific gravity compared to the head main body (d), the head (a) has a low center of gravity.

However, since the club head (a) has the crown portion (b) made of low rigidity material compared to a metallic material, a low vibration frequency is produced at the time of hitting ball, and thereby hitting sound thereof tends to be lower and have a short reverberation, which are generally displeasing for golfers.

SUMMARY OF THE INVENTION

The present invention has been worked out in light of the circumstances described above, and has a main object of providing a golf club head and a golf club in which the hitting feel is improved while maintaining a low center of gravity. In accordance with the present invention, there is provided a golf club head having a hollow portion therein, including: a head main body provided with at least one opening which includes at least a part of a sole portion forming a bottom of the head; a resin member composed of a fiber reinforced resin which is attached to the head main body so as to close the opening; and a reinforcing member across the opening having a specific gravity greater than that of the resin member.

BRIEF DESCRIPTION OF THE DRAWINGS

FIG. 6(*b*) is a cross sectional view taken along a line B-B of FIG. 6(*a*).

DESCRIPTION OF THE PREFERRED EMBODIMENTS

Figure 1:
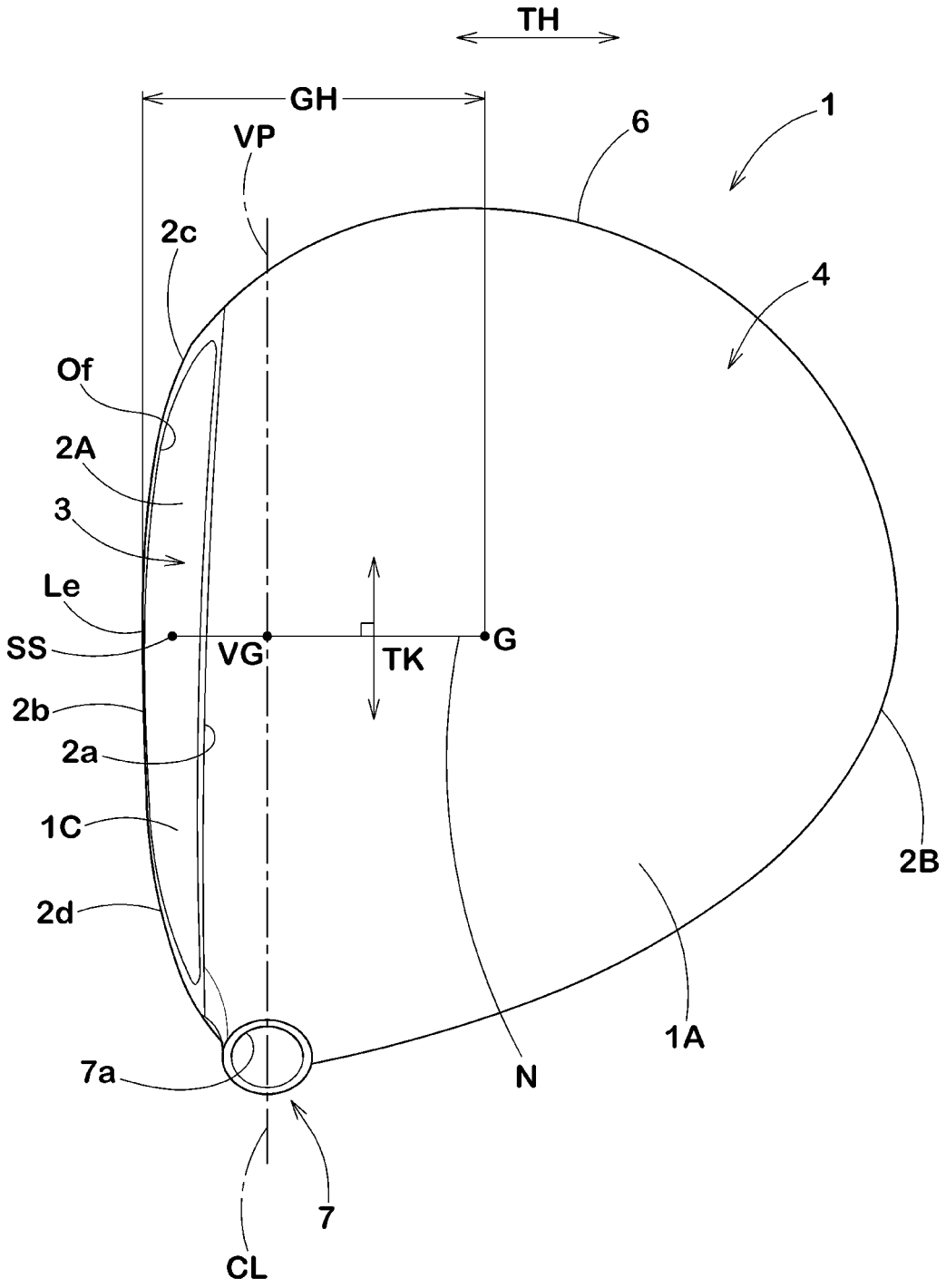
FIG. 1 is a plan view of a golf club head under a standard state according to one embodiment of the present invention.
Figure 2:
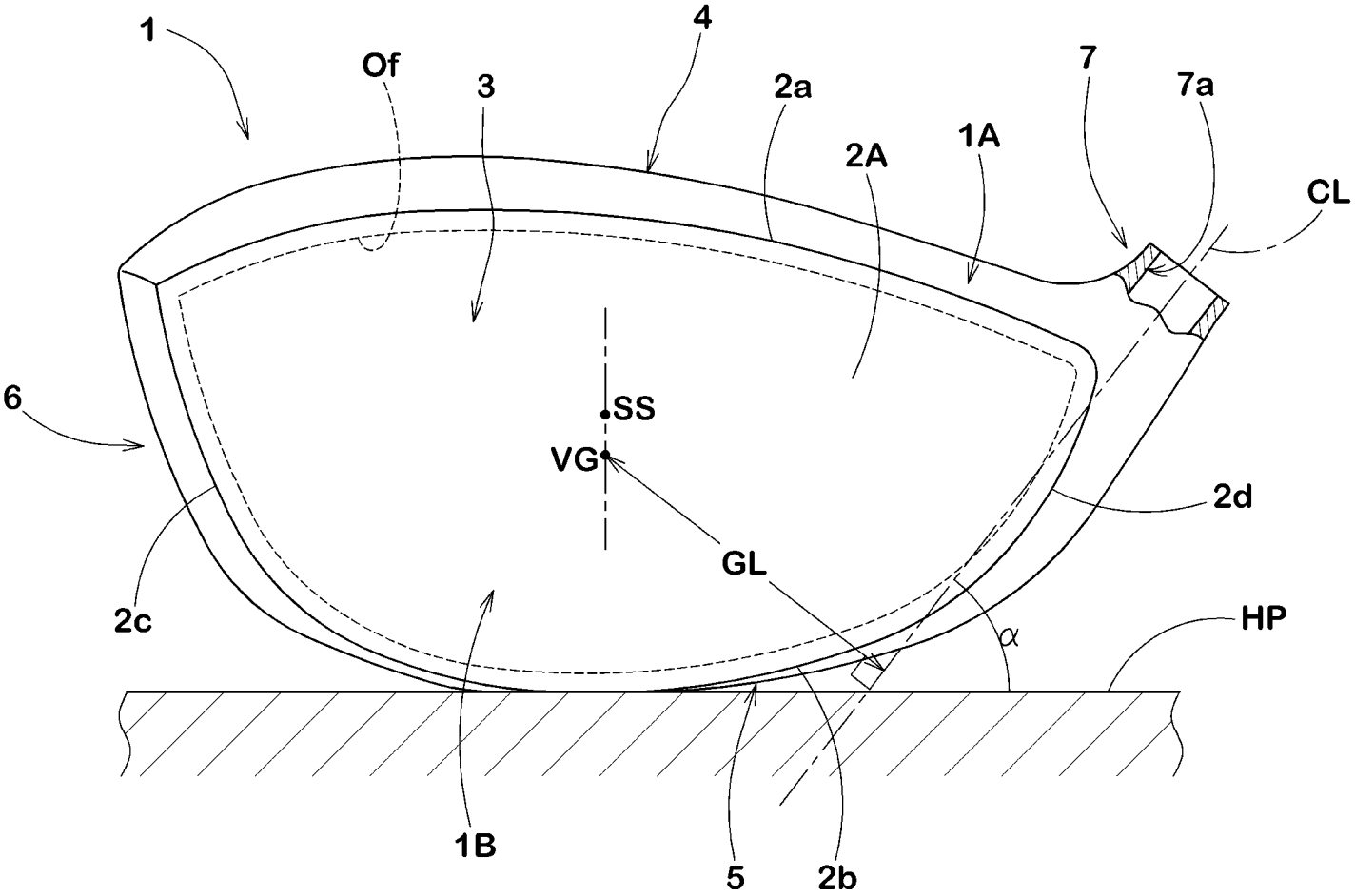
FIG. 2 is a front view of FIG. 1.

In the following, one embodiment of the present invention will be described based on the drawings.

FIG. 1 to FIG. 5 show a golf club head 1 (which may be hereinafter simply referred to as a "head" or "club head") under a standard state of the embodiment. Here, the standard state of the head 1 is a state in which the head 1 is placed on a horizontal plane HP with a centerline CL of a shaft axis being disposed in a vertical plane VP and inclined at a specified lie angle, and a club face 2A being held at a loft angle β

(a face angle thereof is set to zero). Also, when the face 2A has a vertical face roll, the loft angle β of the face 2A is determined as an angle between the vertical plane VP and the tangent passing through a sweet spot SS of the face 2A.

Unless otherwise stated, the club head 1 is in the standard state. In addition, the loft angle is given as an angle of larger than 0 degrees. In the specification, a front-back direction of the head is a direction TH parallel to a normal N extended down from a center of gravity G of the head to the face 2A, in a plan view in the standard state. A toe-heel direction of the head is a direction TK orthogonal to the normal N in the plan view. Note that an intersection of the normal N and the face 2A is the sweet spot SS.

The club head 1 comprises: a face portion 3 with the face 2A which forms a hitting surface to hit ball; a crown portion 4 which is connected to an upper edge 2*a* of the face 2A and forms a top surface of the head; a sole portion 5 which is connected to a lower edge 2*b* of the face 2A and forms a bottom surface of the head; a side portion 6 which connects between the crown portion 4 and the sole portion 5 and extends from a toe-side edge 2*c* of the face 2A to a heel-side edge 2*d* of the face 2A through a back face 2B; and a hosel portion 7 with a cylindrically shaped shaft insertion hole 7*a* which is provided on a heel side of the crown portion 4 and into which an end of a golf club shaft (not shown) is inserted. In addition, a golf club is configured by attaching the golf club shaft (both not shown) to the shaft insertion hole 7*a* of the hosel portion 7.

The head 1 has a hollow portion (i) therein, and is preferably configured as a wood type. A golf club head of the wood type includes at least Driver (#1), Brassy (#2), Spoon (#3), Baffy (#4), and creek (#5), and also includes a club head which differs from those listed in the club number or a name but has a similar shape.

Although no specific limitation is set on volume v of the head 1, it is preferably not less than 200 $cm^3$, and more preferably not less than 220 $cm^3$. Such a large volume of the head is useful in making the moment of inertia or center of gravity of the head 1 deeper. On the other hand, too large volume of the club head 1 causes such problems as an increase in head weight, deterioration of swing balance and violation of golf regulations and the like, accordingly the volume of the head 1 is preferably not more than 460 $cm^3$.

There is a tendency that if mass of the head 1 is too small, kinetic energy of the head decreases, and thus improvement of flight distance cannot be expected. To the contrary, there is a tendency that if the mass of the head 1 is too large, taking a full swing becomes difficult and directional stability or flight distance of a hit ball degrades. From such a view point, the mass of the head 1 is preferably not less than 180 g and more preferably not less than 190 g, and preferably not more than 210 g and more preferably not more than 200 g.

Figure 5:
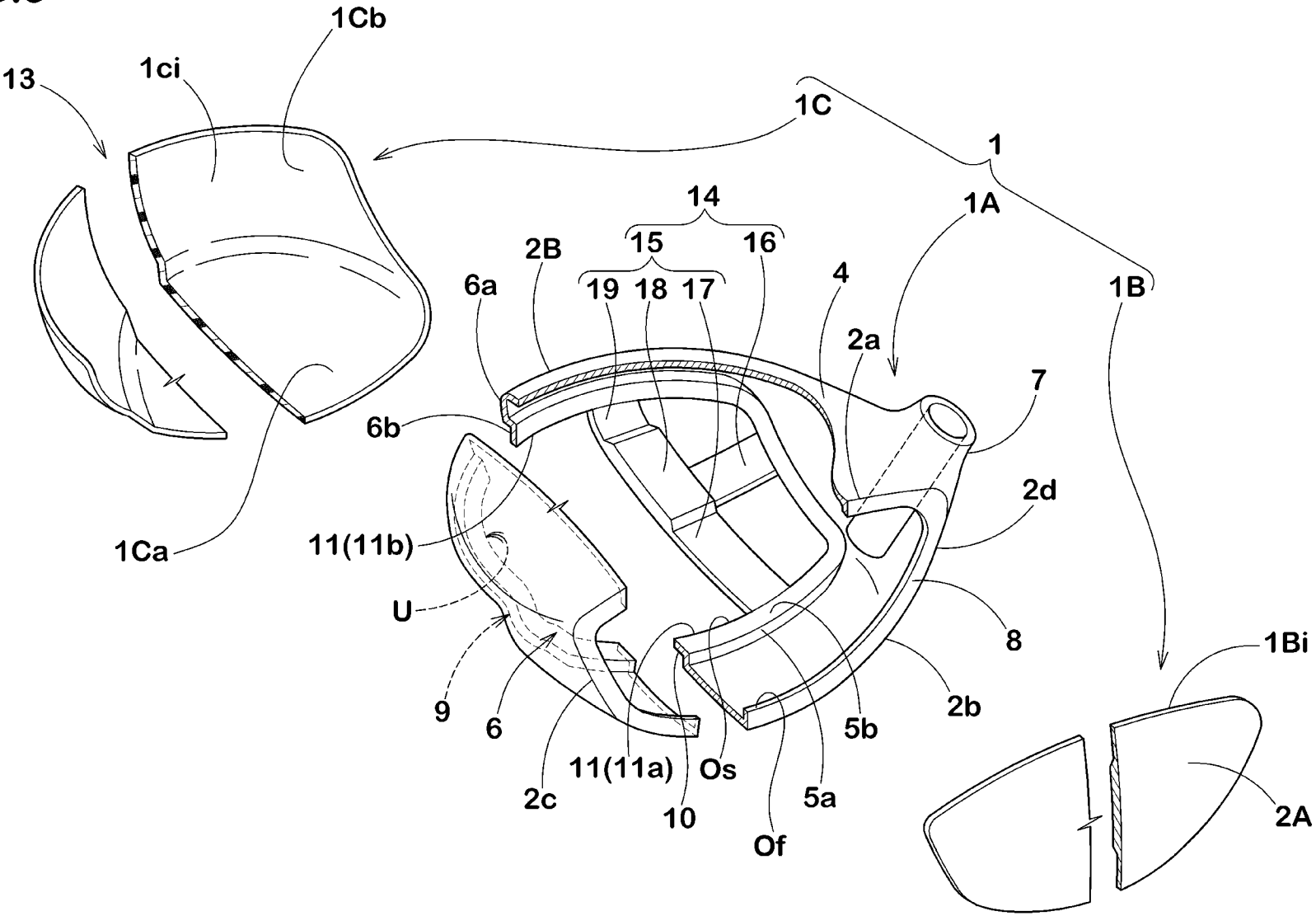
FIG. 5 is an exploded perspective view of FIG. 1.

As shown in FIG. 5, the head 1 includes: a head main body 1A being provided with a face opening (of) in the face portion 3 and a sole opening Os in the sole portion 5; a face member 1B attached to the head main body 1A to close the face opening (of); a sole member 1C attached to the head main body 1A to close the sole opening Os; and a reinforcing member 14 across the sole opening Os.

The head main body 1A includes: a face periphery 8 being provided around the face opening (Of) in the face portion 3; the crown portion 4; the hosel portion 7; and a sole-side periphery 9 being provided around the sole opening (Os) in the sole and side portions 5 and 6. The sole-side periphery 9 includes both a part of sole portion 5 and a part of side portion 6.

The face opening (Of) is provided within the face 2A which is surrounded by each edge 2*a* to 2*d* thereof. In this embodiment, the face periphery 8 continuously extends around the face opening (Of) in the face portion 3 with a substantially constant width. Although the configuration of the face opening (Of) is not particularly limited, a smooth configurational along the configuration of the face 2A is preferable.

The sole opening Os is separated backward from the lower edge 2*b* of the face 2A, and spreads from the sole portion 5 to the side portion 6. In this embodiment, sole-side periphery 9 is continuously provided around the sole opening Os in the sole and side portions 5 and 6. Although the configuration of the sole opening Os is not particularly limited, the sole opening Os may be provided within the sole portion 5.

The sole-side periphery 9 includes: a sole main portion 5*a* with a finished surface of the sole portion 5; a stepped sole support portion 5*b* dented from the sole main portion 5*a* into the hollow portion a side main portion 6*a* with a finished surface of the side portion 6; and a stepped side support portion 6*b* dented from the side main portion 6*a* into the hollow portion i.

The stepped sole support portion 5*b* and the stepped side support portion 6*b* are connected each other, and thereby the support portion U is continuously formed around the sole opening Os. The support portion U can support the periphery on the inner surface 1Ci of the sole member 1*c*, and it serves to make flush surface of the head 1. The support portion U comprises an outer surface 10 in contact with the inner surface 1Ci of the sole member 1C and an end surface 11 which defines the configuration of the sole opening Os.

The head main body 1A is composed by using a metallic material such as stainless steel, maraging steel, titanium, titanium alloy or amorphous alloy and the like. Accordingly, since the club head 1 has the crown portion 4 made of metallic material, a high vibration frequency may be produced at the time of hitting ball, and thereby the hitting sound also tends to be higher and have a long reverberation, which improves the hitting feel for golfers.

The head main body 1A can be produced by using two or more metal materials. The head main body 1A may be such that respective portions described above are integrally formed by forging and the like from the beginning or two or more parts are molded by a processing method such as forging, casting, pressing or rolling and the like, and then these are integrally bonded by welding and the like.

The face member 1B is formed as a plate shape, and is made of titanium alloy with a high specific strength such as Ti-15V-6Cr-4Al and Ti-6Al-4V, for example. The face member 1B preferably has an area being more than 60% of the face 2A and further preferably includes the sweet spot SS.

The face member 1B is attached to the edge of the face opening (of) by welding or brazing. In order to ensure the strength of the face member 1B after welding, laser welding is preferable which gives the face member 1B less heat-affected zone during welding.

The sole member 1*c* is formed of a resin member 13 composed of a fiber reinforced resin. Namely, the resin member 13 is disposed on each part of the sole portion 5 and the side portion 6 which does not influence over the hitting sound. Accordingly, the head 1 according to the present invention provides a high vibration frequency at the time of hitting ball, and thereby hitting sound thereof also tends to be higher and have along reverberation, which improves the hitting feel for golfers.

Here, if the area of the resin member 13 is too large in the sole portion 5, the rigidity of the head 1 tends to deteriorate. On the other hand, if the area of the resin member 13 is too small in the sole portion 5, it may be difficult to obtain a mass margin to design the center of gravity of the head 1. From this point of view, the ratio Sb/Sa of the area Sb of the resin member 13 included in the sole portion 5 projected onto the outer surface of the head 1 to the area Sa of the sole portion 5 is preferably not less than 65%, more preferably not less than 70%, and preferably not more than 85% and more preferably not more than 80%.

As shown in FIG. 5, the sole member 1C according to the present embodiment comprises a sole section 1Ca forming a part of the sole portion 5 and a side section 1Cb extending upward from the sole section 1Ca and forming a part of the side portion 6. The periphery of the inner surface 1Ci of the sole member is attached on the outer surface 10 of the support portion u.

Figure 3:
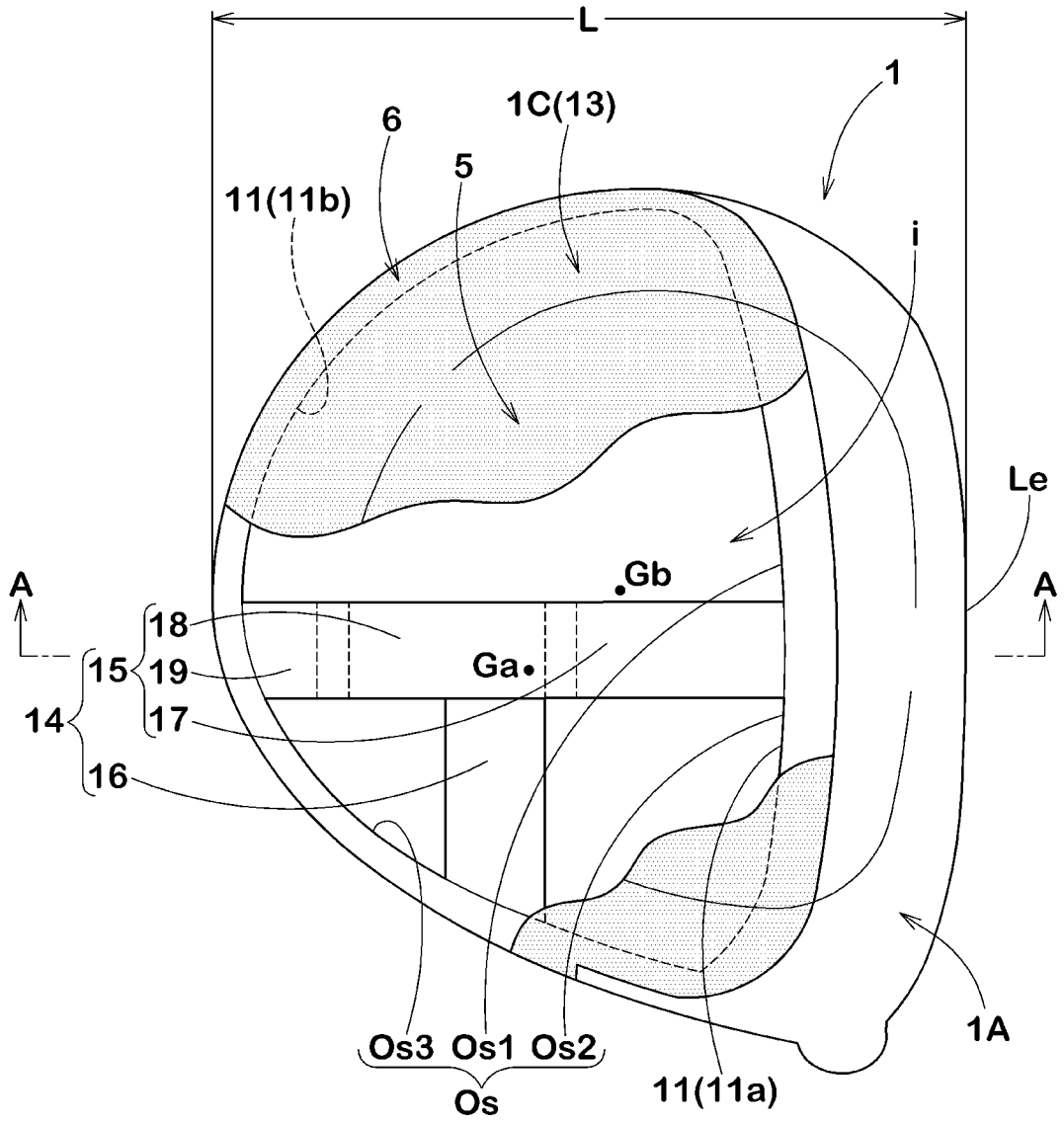
FIG. 3 is a bottom view of FIG. 1.

As shown in FIG. 3 and FIG. 5, the reinforcing member 14 is attached to the head main body 1A. The reinforcing member extends across the sole opening Os so as to divide it into at least two openings. In this embodiment, each end of the reinforcing member 14 is attached to opening edge 11 of the sole opening Os. The reinforcing member 14 has a specific gravity greater than that of the resin member 13. Accordingly, a concentrated large weight is distributed in the sole portion 5 using a weight margin obtained by the resin member 13 while maintaining the head weight, and thereby the head 1 makes possible to have a low center of gravity.

The reinforcing member 14 has a first portion 15 extending in the front-back direction of the head 1 and a second portion 16 extending from the first portion 15 toward the heel side of the head 1. As shown in FIG. 3, the second portion 16 in this embodiment is connected to a longitudinal center area of the first portion 15 so that the configuration of the reinforcing member 14 has a T-shaped in the bottom view of the head 1. Accordingly, the reinforcing member 14 divides the sole opening Os into three small openings which includes a toe-side section Os1 disposed in the toe side of the head 1, a front-heel-side section Os2 disposed in the front and heel side of the head 1, and the rear-heel-side section Os3 disposed in the rear and heel side of the head 1.

The first portion 15 extends from the opening edge 11*a* located in the front side of the head 1 to the opening edge 11*b* located in the rear side of the head 1 in parallel with the front-back direction. In this embodiment, the first portion 15 of the reinforcing member 14 has a substantially constant width. Since the first portion 15 increases the rigidity in the front-back direction of the head 1, it serves to reduce the vibration of the head 1 even if the head 1 hit the ground during a golf swing.

Figure 4:
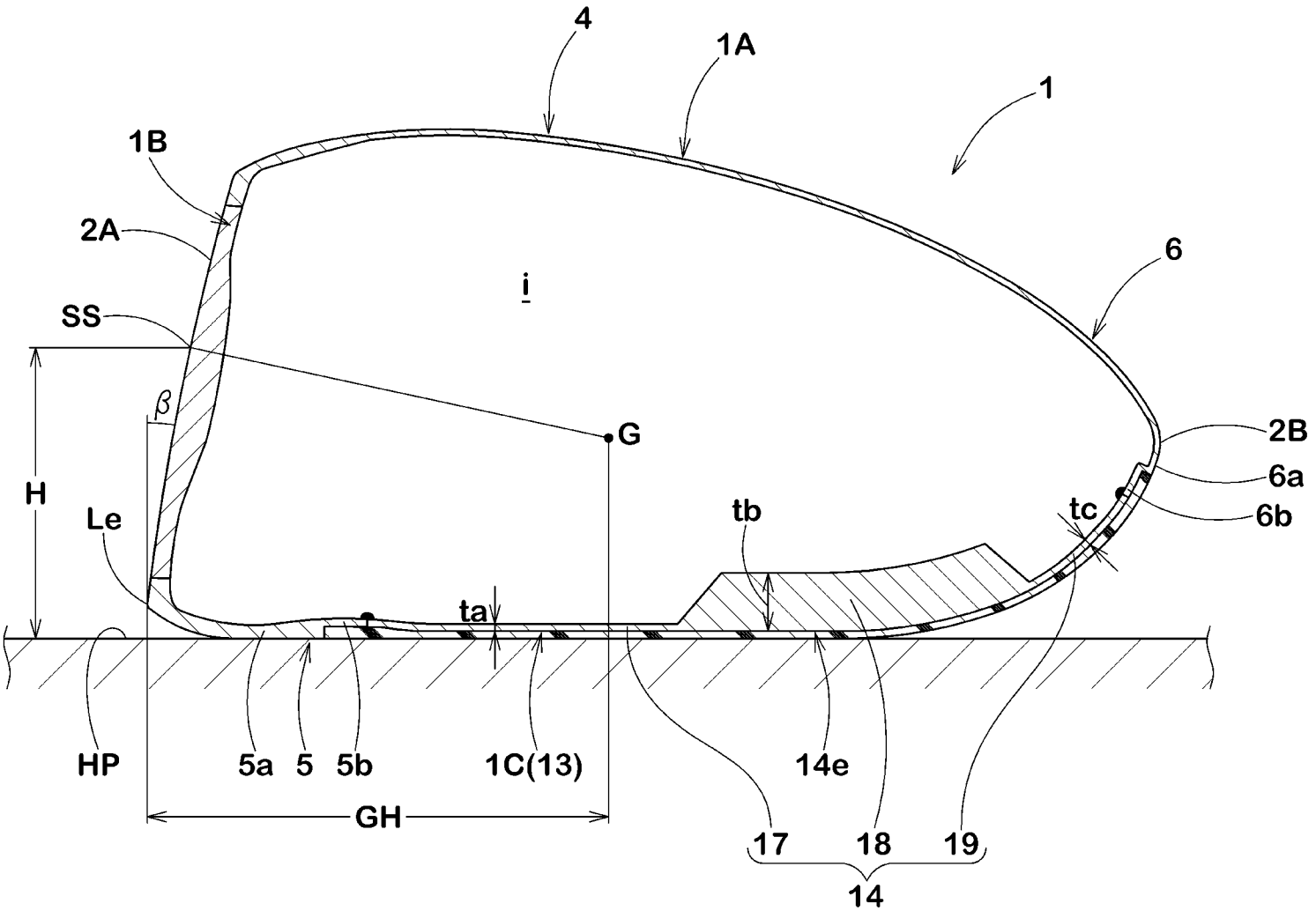
FIG. 4 is a cross sectional view of taken along a line A-A of FIG. 3.

As shown in FIGS. 3 and 4, the first portion 15 of the reinforcing member 14 comprises: a front portion 17 extending from the front side opening edge 11*a* of the sole opening Os with a small thickness; a rear portion 19 extending from the rear side opening edge 11*b* of the sole portion Os with a small thickness; and a middle portion 18 provided there between and having a thickness greater than those of the front and rear portions 17 and 19.

In this embodiment, the front portion 17 has the same thickness ta with the stepped sole support portion 5*b*, in order to prevent increase of the head weight while maintaining the rigidity of the sole portion. The thickness ta is preferably in a range of from 0.5 to 1.0 mm.

The middle portion 18 has a thickness tb greater than the thickness ta of the front portion 17. Also, the middle portion 18 is provided in the rear side of the first portion 15 to shift the center of gravity G of the head 1 backward, and thereby the center of gravity depth GH may be enlarged. Here, the center of gravity depth GH is a front-back distance between the leading edge Le of the head 1 and the center of gravity G of the head 1. The leading edge is the most front side portion of the head under the standard state.

The head 1 with a large center of gravity depth GH is possible to improve the directionality of hit ball based on less movements at impact, even if the ball is hit at the outside the sweet spot SS of the face 2A. Here, if the middle portion with a large weight is disposed too backward, swing balance tends to be deteriorated due to the large center of gravity depth GH. Accordingly, the middle portion 18 is preferably disposed in an area which separates from the leading edge not less than 45% of the head length L, and is preferably disposed in an area within from the leading edge Le not more than 95%, and preferably not more than 90% of the head length L. Here, the head length L is a front-back distance between the leading edge Le and the outmost point of the head 1. In order to improve effects described above, the thickness tb of the middle portion 18 is preferably in a range of from 4.0 to 8.0 mm.

In this embodiment, the rear portion 19 has the same thickness tc with the stepped side support portion 6*b*, in order to prevent increase of the head weight while maintaining the rigidity of the side portion. The thickness tc is preferably in a range of from 0.5 to 1.0 mm.

As shown in FIG. 3, the second portion 16 extends between the opening edge 11 of the sole opening Os and the middle portion 18 of the first portion 15 in parallel with the toe-heel direction. In this embodiment, the second portion 16 of the reinforcing member 14 has a substantially constant width. The second portion 16 of the reinforcing member 14 further improves the rigidity of the head main body 1A. The second portion 16 is not particularly limited to this embodiments descried above and may be changed to different aspects as needed.

As shown in FIG. 3, the center of gravity Ga of the reinforcing member 14 in this embodiment is located in the heel side of the head 1 than the center of gravity Gb of the imaginary head 1 without the reinforcing member 14. Such the head 1 in accordance with the present embodiment has a short center of gravity-distance, and thereby the directionality of hit ball is improved due to less movement of the head 1 during a golf swing. Here, the center of gravity distance is the minimum distance between the centerline CL of the shaft and a projected center of gravity VG at where the normal N intersects the vertical plane VP under the standard state, as shown in FIG. 1.

As shown in FIG. 4, the reinforcing member 14 and the resin member 13 are overlapped in contact with each other. Namely, the outer surface 14*e* of the reinforcing member 14 facing to the outside of the head 1 corresponds to the inner surface 1Ci of the sole member 1C to reinforce the resin member 1C with high durability. Also, the overlapped structure above is possible to employ much more thin resin member 13 while obtaining durability of the club head 1 and mass margin. Therefore, the club head 1 in accordance with the present embodiment may have flexibility in design freedom of weights using the large mass margin.

The reinforcing member 14 described above may be preferably made of a different material from the head main body 1A to adjust the moment of inertia of the head 1 or the location of the center of gravity as desired. Especially, in order to maintain a low center of gravity of the head, the reinforcing member 14 preferably has a specific gravity greater than that of the head main body 1A. On the other hand, the reinforcing member 14 may be made of the same material with the head main body 1A. In this case, it may be possible to previously integrate with each other so that manufacturing time of the head 1 is shortened. As for the reinforcing member 14, although various materials which have specific gravities greater than that of the resin member 13 are employed, a metallic material is preferably employed. When the reinforcing member 14 is made of a metallic material, there is an advantage that welding may be employed to firmly joint the head main body 1A and the reinforcing member 14. As for the metallic material, tungsten or tungsten alloy may be employed. As for joint ways between the reinforcing member 14 and the head main body 1A, brazing, adhesive agent or calking may also be employed.

Figure 6A:
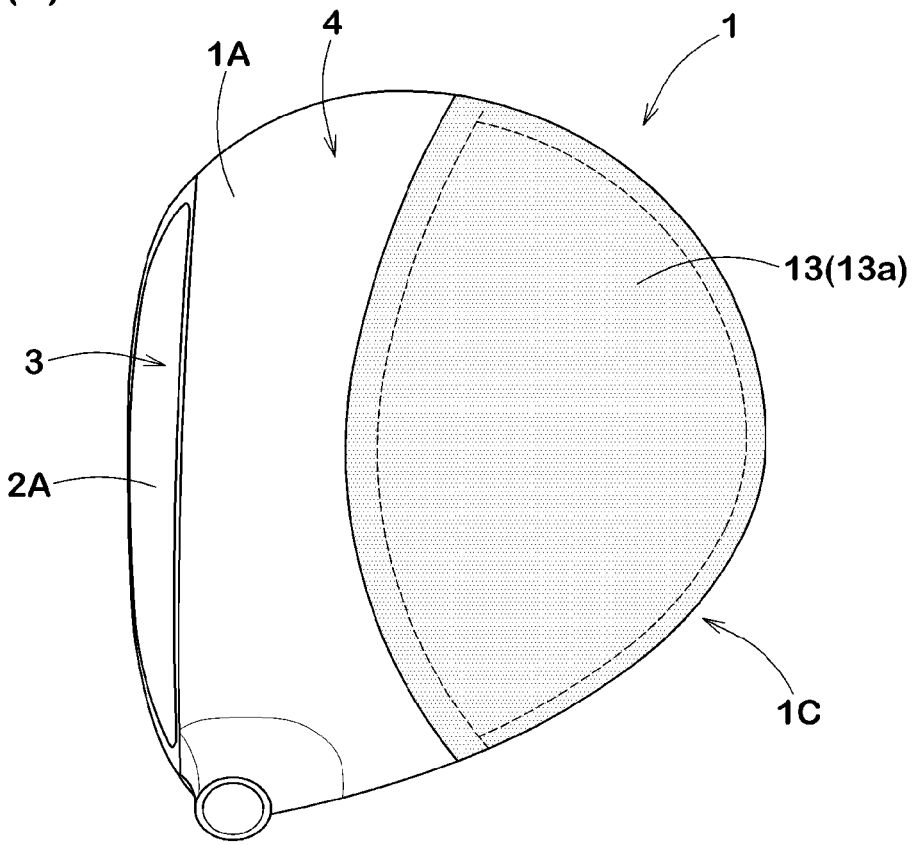
FIG. 6(*a*) is a plan view according to another embodiment.
Figure 6B:
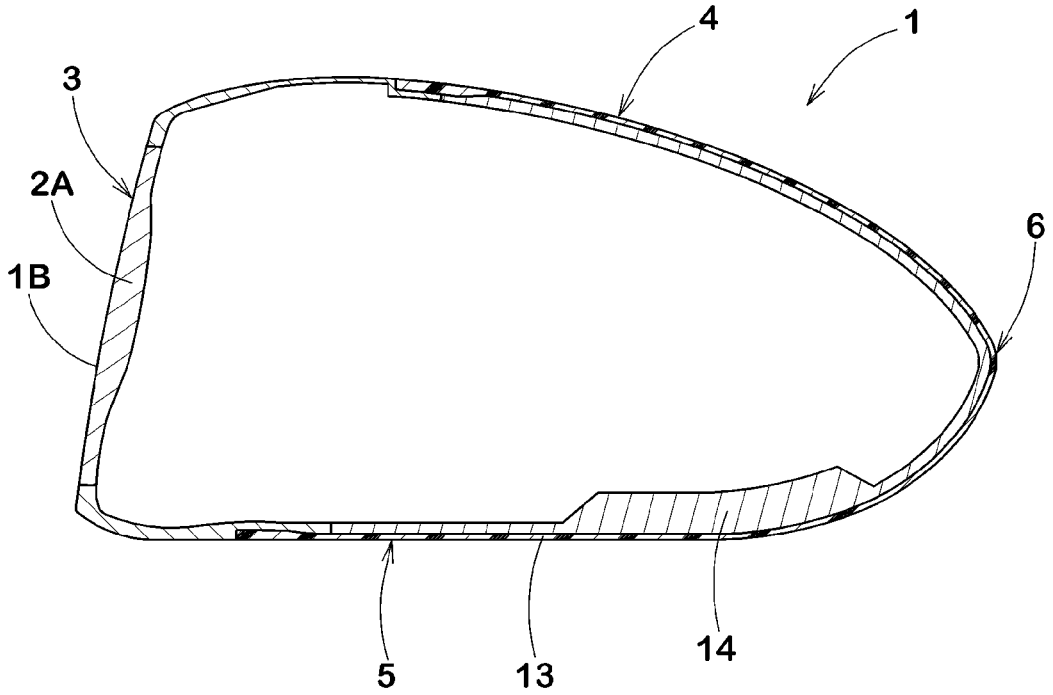

As shown in FIGS. 6(*a*) and 6(*b*), the head main body 1A may have the sole opening Os which continuously extends from the sole portion 5 to the crown portion 4 through the side portion 6 to maintain a low center of gravity of the head 1. However, if the resin member 13 includes a large area in the crown portion 4, hitting feel of the head 1 may be deteriorated. Accordingly, the ratio Sc/Sd of the surface area Sc of the resin member 13 included in the crown portion 4 to the area Sd of the crown portion 4 is preferably not more than 70%, and more preferably not more than 60%.

Figure 7A:
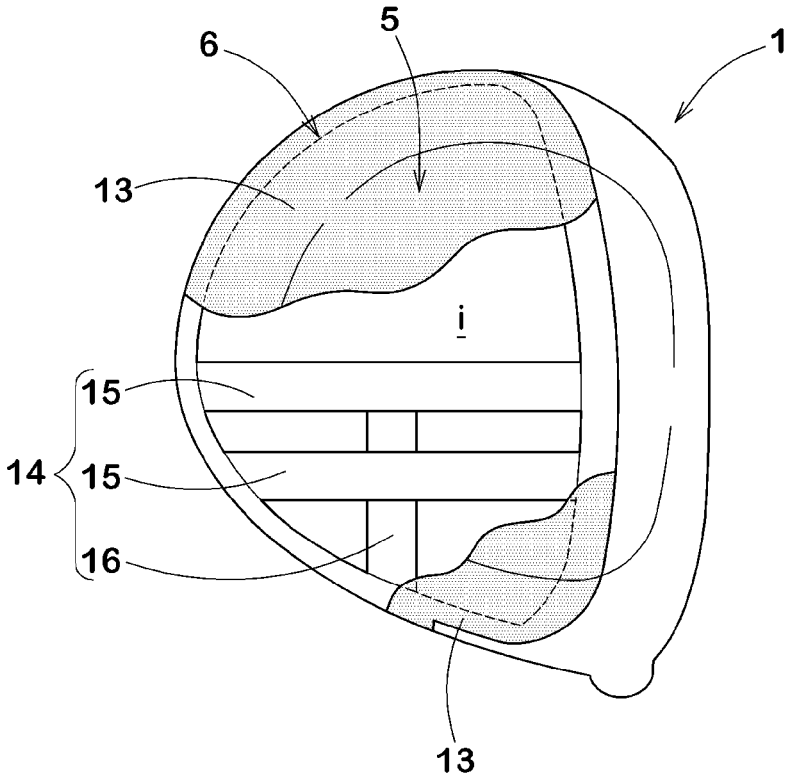
FIGS. 7(*a*) and 7(*b*) are bottom views of golf club heads according to other embodiments.
Figure 7B:
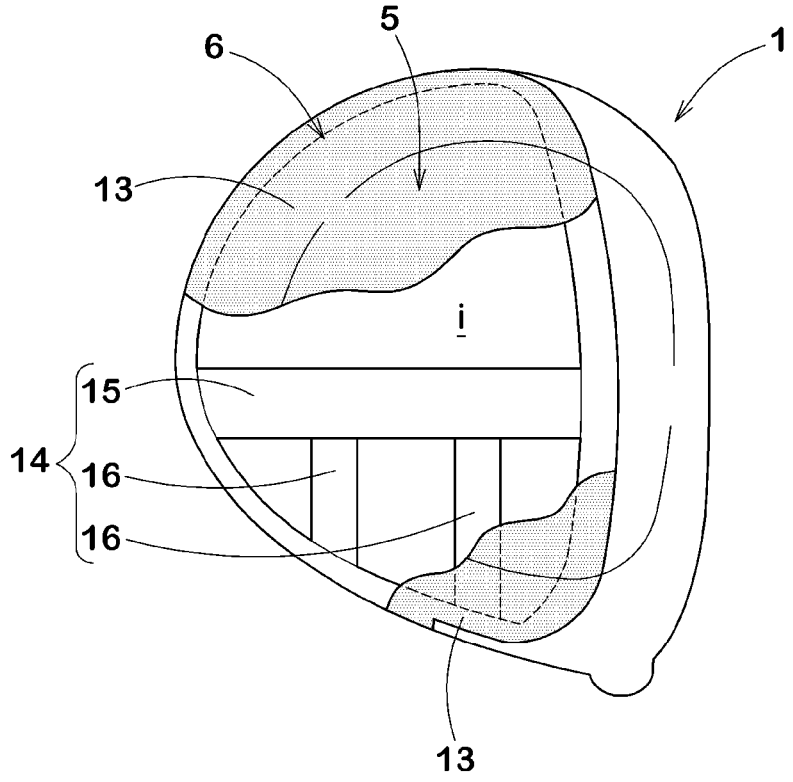

As shown in FIG. 7(*a*), the reinforcing member 14 may have a plurality of (two in this embodiment) first portions 15, as desired. Also, as shown in FIG. 7(*b*), the reinforcing member 14 may have a plurality of (two in this embodiment) second portions 16. In addition, the reinforcing member 14 may have a plurality of first portions 15 and second portions 16, respectively (not shown) to reduce vibration of the head 1 when the head 1 hits the ground during golf swing.

In the present invention, one of these embodiments described above can be employed in combination with the other one of embodiments. Moreover, although the present invention has been described so far in detail, the present invention is not limited to the specific embodiments descried above and may be changed to different aspects as desired.

Comparison Test:

In order to confirm advantageous effects of the present invention, wood-type golf club heads (drivers) based on FIG. 1 to FIG. 5 were prototyped, and tests were conducted on locations of center of gravities, hit ball feeling and vibration of heads. All parameters other than those shown in Table 1 are identical and main common specifications and testing methods are as follows.

Head volume: 460 $cm^3$

Head main body: Ti-811 with specific gravity of 4.37

Face member: Ti-X51AF with specific gravity of 4.38

Reinforcing member: Ti-811 with specific gravity of 4.37

Thickness to of front portion: 0.7 mm

Thickness tb of middle portion: 6.0 mm

Thickness tc of rear portion: 0.7 mm

Center of Gravity Test:

As shown in FIG. 4, the height H from the horizontal plane HP to the sweet spot SS was measured at each head being placed under the standard state. The smaller the value, the lower the center of gravity of the head is.

Hit Ball Feeling Test:

wood-type golf clubs with 45-inches were manufactured by attaching identical FRP shafts (MP600, Flex R manufactured by SRI Sports Limited) to respective heads. Using the clubs and golf balls ("XXIO XD" (registered trademark of SRI Sports Limited) manufactured by the same company described above), an actual hit test was conducted by fifty 3- to 26-handicappers, and hit ball feeling was evaluated on a scale of a ten in terms of loudness of hitting sound and length of reverberation of ball hits. The result was expressed as a mean value of the 50 golfers. The larger the value, the better the hit ball feeling is.

Vibration Test:

In the hit ball feeling test, unpleasing vibration produced at the time of miss shots was evaluated in terms of scale. The result was expressed as a mean value of the 50 golfers. The smaller the value, the better the performance is.

Table 1 shows the test results, and the like.

TABLE 1-1

Figure 8:
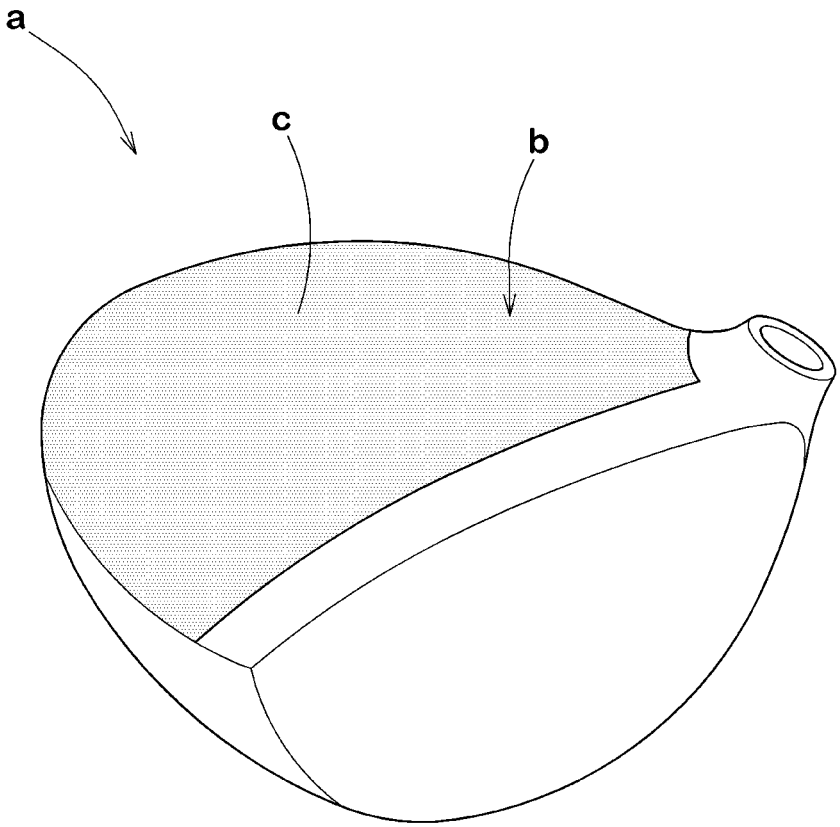
FIG.8 PRIOR ART
FIG. 8 is a perspective view of a conventional golf club head.

| | Ref. 1 | Ex. 1 | Ex. 2 | Ex. 3 | Ex. 4 | Ex. 5 |
|---|---|---|---|---|---|---|
| Head construction | FIG. 8 | FIG. 1 | FIG. 1 | FIG. 1 | FIG. 1 | FIG. 1 |
| Resin area in sole portion Sb/Sa (%) | 0 | 78 | 55 | 65 | 85 | 90 |
| Resin area in crown portion Sc/Sd (%) | 80 | 0 | 0 | 0 | 0 | 0 |
| Arrangement area of middle portion (%) * | — | 50-90 | 50-90 | 50-90 | 50-90 | 50-90 |
| Height of Center of gravity (mm) | 32.0 | 33.6 | 33.2 | 33.4 | 33.8 | 34.0 |
| Hitting feel Test [Score] | 5.5 | 9.2 | 8.0 | 8.4 | 8.5 | 7.9 |
| Vibration test [Score] | 7.2 | 5.0 | 5.0 | 5.0 | 5.0 | 5.0 |

* It shows an area of the middle portion from the leading edge with respect to the head length L.

TABLE 1-2

| | Ex. 6 | Ex. 7 | Ex. 8 | Ex. 9 | Ex. 10 | Ex. 11 |
|---|---|---|---|---|---|---|
| Head construction | FIG. 6 | FIG. 6 | FIG. 1 | FIG. 1 | FIG. 1 | FIG. 7a |
| Resin area in sole portion Sb/Sa (%) | 78 | 78 | 78 | 78 | 78 | 78 |
| Resin area in crown portion Sc/Sd (%) | 70 | 80 | 0 | 0 | 0 | 0 |
| Arrangement area of middle portion (%) * | 50-90 | 50-90 | 45-95 | 50-100 | 40-90 | 50-90 |
| Height of Center of gravity (mm) | 32.4 | 32.2 | 33.6 | 33.6 | 33.6 | 33.6 |
| Hitting feel Test [Score] | 8.5 | 7.5 | 9.2 | 9.2 | 9.2 | 9.2 |
| Vibration test [Score] | 5.2 | 5.1 | 6.0 | 6.0 | 6.3 | 5.5 |

* It shows an area of the middle portion from the leading edge with respect to the head length L.

As a result of the tests, it was confirmed that hitting feel in examples are improved while maintaining low center of gravities compared to references.

The invention claimed is:

1. A golf club head having a hollow portion therein, including:

a head main body provided with at least one opening which includes at least a part of a sole portion forming a bottom of the head;

a resin member composed of a fiber reinforced resin which is attached to the head main body so as to close the opening; and a reinforcing member extending across the opening so as to divide it into at least two openings and having a specific gravity greater than that of the resin member, wherein the reinforcing member has a first portion extending in a front-back direction of the head, wherein the first portion includes a front portion, a rear portion and a middle portion there between in the front-back direction, and wherein the middle portion has a thickness greater than those of the front and rear portions.

2. The golf club head according to claim 1, wherein the resin member and the reinforcing member are overlapped each other.

3. The golf club head according to claim 1 or 2, wherein the reinforcing member is made of a different material from the head main body.

4. The golf club head according to claim 1 or 2, wherein the reinforcing member has a center of gravity, and the center of gravity of the reinforcing member is located in a heel side of the head compared to a center of gravity of the head without the reinforcing member.

5. The golf club head according to claim 1, wherein the reinforcing member has a second portion extending from the first portion toward a heel side of the head.

6. The golf club head according to claim 1 or 2, wherein the reinforcing member is made of a metallic material.

7. The golf club head according to claim 5, wherein the second portion is connected to the middle portion of the first portion.

8. A golf club including a golf club shaft and the golf club head according to claim 1 or 2.

9. The golf club head according to claim 5, wherein the second portion is connected with the first portion so that the configuration of the reinforcing member has a T-shape in a bottom view of the head.

10. The golf club head according to claim 1, wherein the reinforcing member comprises a plurality of the first portion.

11. The golf club head according to claim 5, wherein the reinforcing member comprises a plurality of the second portion.

* * * * *